United States Patent [19]

Ashe et al.

[11] Patent Number: 4,794,367

[45] Date of Patent: Dec. 27, 1988

[54] CIRCUIT ARRANGEMENT

[75] Inventors: James Ashe; Nicholas Chandler; Andrew J. Crofts, all of Essex, England

[73] Assignee: Marconi Electronic Devices Limited, Stanmore, United Kingdom

[21] Appl. No.: 943,028

[22] Filed: Dec. 18, 1986

[30] Foreign Application Priority Data

Dec. 19, 1985 [GB] United Kingdom ..... 8531324

[51] Int. Cl.[4] ..... H01C 1/012

[52] U.S. Cl. ..... 338/308; 338/312; 29/610.1

[58] Field of Search ..... 338/308, 312, 306, 307; 219/121 LM; 29/610 R

[56] References Cited

U.S. PATENT DOCUMENTS

| | | | |
|---|---|---|---|
| 4,294,648 | 10/1984 | Brede et al. | 338/308 X |
| 4,486,738 | 12/1984 | Sadlo et al. | 338/312 X |

FOREIGN PATENT DOCUMENTS

| | | |
|---|---|---|
| 696207 | 8/1953 | United Kingdom . |
| 1566151 | 4/1980 | United Kingdom . |
| 2131625 | 4/1984 | United Kingdom . |
| 2132030 | 6/1984 | United Kingdom . |
| 2154373A | 9/1985 | United Kingdom . |

*Primary Examiner*—E. A. Goldberg
*Assistant Examiner*—M. M. Lateef
*Attorney, Agent, or Firm*—Spencer & Frank

[57] ABSTRACT

In a thin film circuit, high values of resistance/surface area can be attained by forming the resistive material as a mesh rather than a solid block. The advantages of this are that it gives a high resistance value in a small area and allows laser trimming, both without adversely affecting resistor characteristics such as stability.

12 Claims, 3 Drawing Sheets

CIRCUIT ARRANGEMENT

BACKGROUND OF THE INVENTION

This invention relates to a circuit arrangement in which a resistor is constituted by a layer of electrically resistive material supported by an insulating substrate. In order to produce such a resistor having a fairly high resistance value it is usual either to make the resistive layer long in relation to its cross-sectional area, or to make the resistive layer very thin. Both of these expedients have attendant disadvantages. For example, a very long narrow resistor may be wasteful of the available area of the insulating substrate, and if it is too thin imperfections in the layer or the surface of the insulating substrate may result in open circuits. Also, it is difficult to reliably manufacture resistors having precisely specified values from a layer of resistive material which is very thin, i.e. of the order of a few hundred Angstroms or less, as the electrical properties of the layer, such as resistance and temperature coefficient of resistance for example, may become unstable or unpredictable as the thickness becomes less.

The present invention seeks to provide an improved circuit arrangement in which the above-mentioned disadvantages can be reduced.

SUMMARY OF THE INVENTION

According to a first aspect of this invention a circuit arrangement includes an electrically insulating substrate supporting a layer of an electrically resistive material in which said layer is provided with a plurality of closed apertures distributed over its surface, each closed aperture being a recess extending through the thickness of the electrically resistive material and being wholly bounded by the resistive material, the resistive material defining a first plurality of electrically parallel paths extending between two terminations and a second plurality of electrically parallel paths which form a plurality of cross linkages between the first plurality of paths, such that said plurality of closed apertures are disposed upon said substrate as a two-dimensional array.

Preferably the apertures are assembled as an array which extends uniformly over substantially the whole of the area of the resistive material.

Conveniently, the array of apertures is formed as a regular pattern in which all of the apertures occupy the same surface area and are equally spaced from each other. Preferably, all of the apertures have the same size and shape.

The resistive layer is preferably formed as a deposition from a vapour, and is formed as a layer having a thickness typically of a few hundred Angstroms. Conveniently the resistive material is nichrome, which has a resistivity which is considerably higher than that of a conventional conductor such as gold or copper.

According to a second aspect of this invention a method of forming a circuit arrangement in which a resistive element has a predetermined value includes the steps of forming upon an insulating substrate a layer of resistive material having therein a plurality of closed apertures distributed over the surface of the substrate, and breaking at least one link of the resistive material between adjacent apertures so as to increase the resistance of the resistive element to its predetermined value.

BRIEF DESCRIPTION OF THE DRAWINGS

The invention is further described by way of example with reference to the accompanying drawings in which.

DESCRIPTION OF THE PREFERRED EMBODIMENT

Figure 1A:
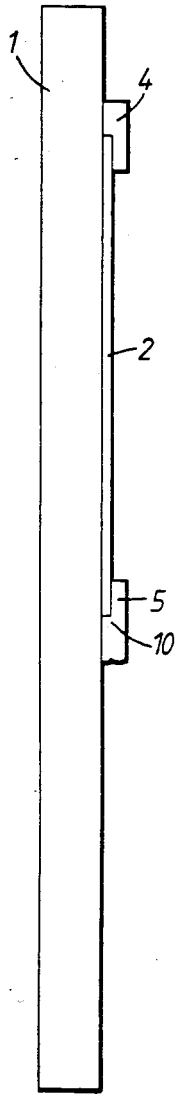
FIGS. 1 and 1A are plan and side views, respectively of one embodiment of the invention.
Figure 1:
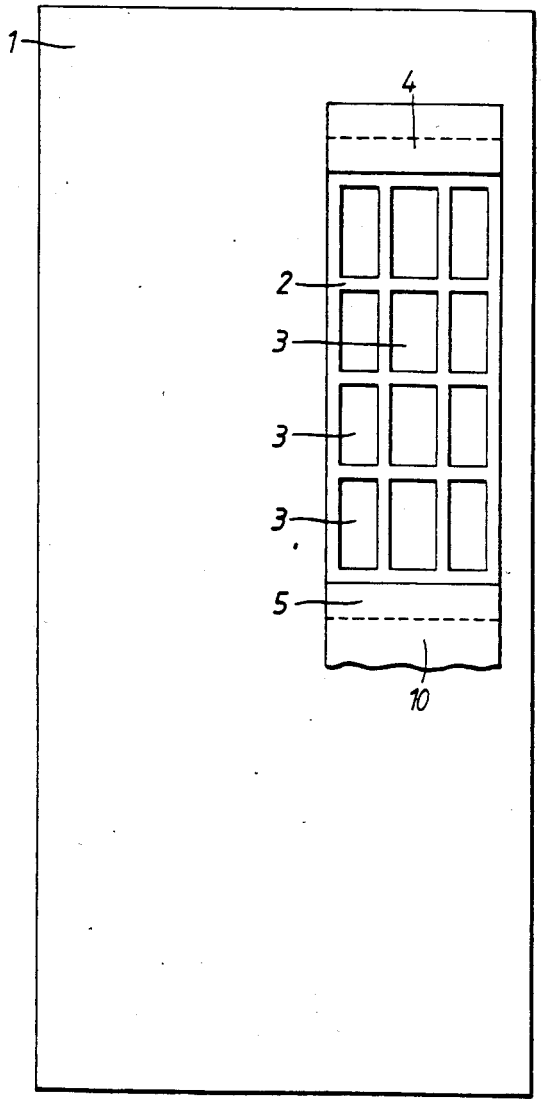

Referring to FIG. 1, the circuit arrangement is shown in plan view and in sectional view, and it consists of a rectangular substrate 1 which supports a thin layer of resistive material 2. The substrate is composed of a thin rigid plate of alumina, which is an inert and very stable insulating ceramic. It is preferably of a very high purity, typically about 99.6% pure alumina, and a suitable thickness for the substrate is about 25 thousandths of an inch. The substrate and its thickness can be chosen with regard to its dielectric constant if the circuit arrangement is to be operative at microwave frequencies. The resistive material 2 is a very thin layer of nichrome, which is a mixture of nickel and chrome having a usefully high resistivity, in this application a mixture of 62.5% nickel and 37.5% chrome was preferred but a very wide range of other ratios could be employed. For a given surface area, the resistance of the resistive material 2 is inversely proportional to its thickness, but it is undesirable to raise the value of its resistance by making the thickness of the layer too thin. If the layer is too thin, the resistance value can be unstable and is difficult to predict.

In FIG. 1, the resistive material 2 is provided with a regular array of closed apertures 3, each of which is in the form of a rectangular hole which extends completely through the thickness of the resistive material 2 to expose the surface of the substrate 1. The layer of nichrome is about 300 Å thick. This thickness is sufficiently great as to give a fairly stable resistivity value. Surface imperfections of the alumina substrate 1 are typically of the same order of magnitude as the thickness of the nichrome, and it is therefore undesirable to produce a layer of nichrome which is much thinner than 300 Å. Additionally, the surface of the nichrome can become oxidised; this can provide a degree of surface passivation, but the effect of the oxidation is to reduce the effective thickness of the resistive layer.

The effective resistance of the layer 2 is increased by selectively removing localised regions to leave the array of closed apertures bounded by narrow links. The resistance is then determined by the nature of the lattice so formed and the widths of the layer remaining between adjacent apertures. By correctly dimensioning these apertures, the effective resistance can be raised to a very high value. Typically, the transverse dimension of an aperture 3 is 12 $\mu$m, and the width of the intervening layer is about 2 $\mu$m. These dimensions are particularly suitable for a nichrome layer on an alumina substrate, as it is found that imperfections in the surface of the substrate are typically of the order of 12 $\mu$m or less across. Although the presence of these imperfections may cause electrical discontinuities in the individual links, this is not a serious drawback, as the configuration of the nichrome lattice shown in FIG. 1 is designed to initially exhibit a lower resistance value than is required. This discontinuity in the links will raise the resistance value towards its required value, and additional links can be intentionally severed as necessary to accurately bring the final resistance value into agreement with that required.

Figure 2:
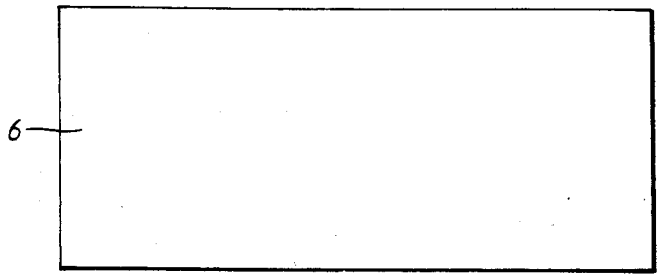
FIGS. 2 to 5 and 2a to 5a show sequential steps in the process by which the circuit arrangement is manufactured.
Figure 2A:
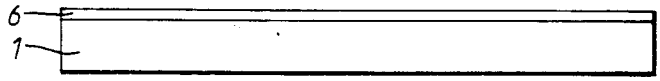
Figure 3:
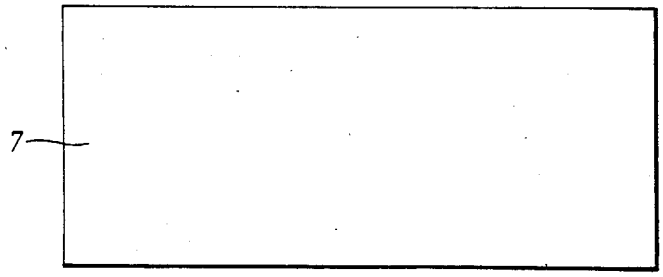
Figure 3A:
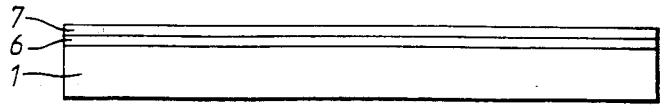
Figure 4:
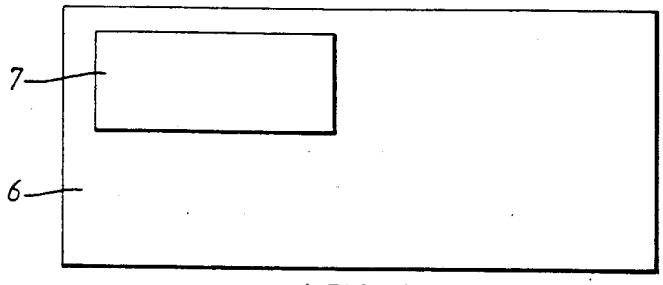
Figure 4A:
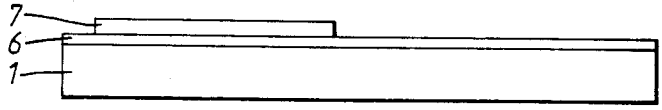

One preferred method of constructing the circuit arrangement shown in FIG. 1 is described with reference to FIGS. 2 to 5. Referring to FIG. 2, the upper surface of the rectangular substrate 1 of polished alumina is completely covered by a layer 6 of nichrome 300 Å thick, by a vacuum deposition technique. Vacuum deposition is a well known technique and does not need to be described in detail. This layer of nichrome is then overlaid completely by a layer 7 of gold 300 Å thick, also by vacuum deposition as is shown in FIG. 3. The layer of gold is then thickened to 3 μm by electroplating. The rectangular area to be occupied by the resistive element is then defined by photo-lithographic masking and all gold not in this area is removed by a chemical etchant, both of these techniques being well known, to leave the structure shown in FIG. 4. Leaving the photolithographic mask in place all nichrome not in the defined area is removed by another chemical etchant and the mask removed.

Figure 5:
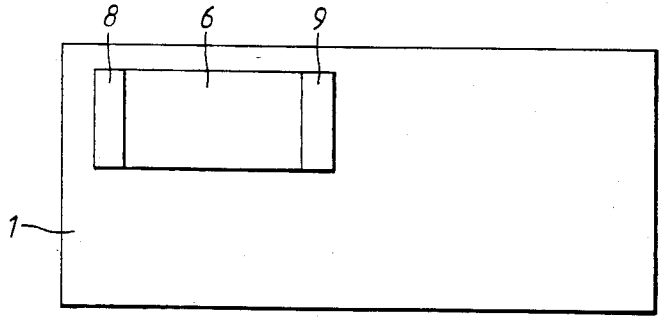
Figure 5A:
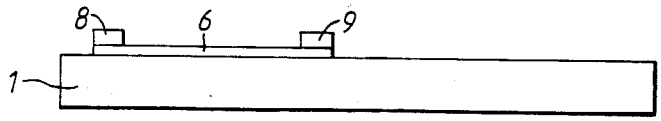

A second photo-lithographic mask is then laid down defining the areas of the contact pads 8 and 9, and a chemical etchant is used to remove all gold except in these areas as shown in FIG. 5, and the mask removed. A third photo-lithographic mask is then laid down defining the areas of nichrome where the apertures are to be formed so as to protect all other areas. All nichrome is then removed from these defined areas by ion-beam milling to produce the lattice structure shown in FIG. 1. Ion-beam milling is a well known technique that need not be described further. The resistor is then baked in air at 300° C. for 3 hours to stabilise the nichrome resistive material.

Typically, a lattice resistor in accordance with the invention will occupy a relatively small area of the substrate 1, and the remaining surface will be occupied by other circuit elements which are interconnected by means of conductive tracks. The resistive material 1 is provided with end contacts 4 and 5 which take the form of gold pads which partially overlie the resistive layer 2, and also serve to link the resistor to the other components on the substrate 1.

The actual resistance is now measured and the requisite numbers of links severed to raise the resistance to its design value. A laser is used to cut through those links which are to be severed.

The resistor is interconnected with other components on the substrate by forming narrow conductive tracks on the substrate in the required positions. These tracks are also composed of gold, and a portion 10 of such a track is shown in FIG. 1.

Instead of using a vapour deposition technique to form the resistor on the substrate (a so-called "thin film" process) the invention can be implemented using a "thick film" process. In such a process, a fluid or paste is printed through a screen onto the substrate, the screen (typically a fine mesh) having solid portions corresponding to the positions of the apertures in the lattice resistor. The fluid or paste is then heated to fire it, thereby solidifying it, and forming a resistive pattern having a required resistivity. Any suitable resistive ink, as the fluid is often termed, can be used to produce the lattice resistor, and the pitch of the mesh screen used determines the geometrical resolution of the lattice. As it can be difficult to control accurately the resistance of a thick film resistor, the ability to trim the resistance value by severing links in the lattice after the lattice has been printed is of particular benefit.

We claim:

1. A circuit arrangement including an electrically insulating substrate having a top surface supporting a layer of an electrically resistive material in which said layer is provided with a plurality of closed apertures distributed over its surface, each closed aperture being a recess extending through the thickness of said electrically resistive material and being wholly bounded by the resistive material and extending to said top surface, said resistive material defining a first plurality of electrically parallel paths extending between two terminations and a second plurality of electrically parallel paths which form a plurality of cross linkages between the first plurality of paths, such that said plurality of closed apertures are disposed upon said substrate as a two-dimensional array.

2. An arrangement as claimed in claim 1 and wherein said apertures are distributed over the entire area of said resistive material.

3. An arrangement as claimed in claim 1 and wherein said apertures are arranged in a regular way such that the first and second plurality of paths together constitute a regular lattice.

4. An arrangement as claimed in claim 1, and wherein each of said apertures is rectangular.

5. An arrangement as claimed in claim 1 and wherein the substrate is an electrically insulating dielectric ceramic.

6. An arrangement as claimed in claim 5 and wherein the substrate is alumina.

7. An arrangement as claimed in claim 1 and wherein the resistive material is nichrome.

8. A method of forming a circuit arrangement in which a resistive element has a predetermined value including the steps of forming upon an insulating substrate having a top surface and a layer of resistive material having therein a plurality of closed apertures distributed over the surface of the substrate and extending to said top surface, the apertures being arranged so that the resistive material between them forms a network having a first and second plurality of electrical paths, the first plurality of current paths being electrically parallel and a second set of current paths being in parallel to one another and forming a plurality of cross-linkages between the first set of current paths; and breaking at least one path of the resistive material between adjacent apertures so as to increase the resistance of the resistive element to its predetermined value.

9. A method of forming a circuit arrangement as claimed in claim 8 and wherein the step of forming upon an insulating substrate a layer of resistive material having therein a plurality of closed apertures distributed over the surface of the substrate includes the steps of; forming a continuous layer of resistive material upon an insulating substrate, and forming a plurality of closed apertures in said layer of resistive material by selective removal of areas of said resistive material.

10. A method of forming a circuit arrangement as claimed in claim 8 and wherein the resistive material between the apertures is formed as a regular lattice.

11. A method as claimed in claim 8 and wherein the link or links is broken by means of a laser.

12. A method as claimed in claim 8, and wherein each closed aperture is formed by means of an ion milling technique which selectively removes part of the layer of resistive material.

* * * * *